US010030876B2

(12) United States Patent
Ogura

(10) Patent No.: US 10,030,876 B2
(45) Date of Patent: Jul. 24, 2018

(54) CEILING-EMBEDDED AIR CONDITIONER

(71) Applicant: FUJITSU GENERAL LIMITED, Kawasaki-shi, Kanagawa-ken (JP)

(72) Inventor: Taku Ogura, Kawasaki (JP)

(73) Assignee: FUJITSU GENERAL LIMITED, Kawasaki-Shi, Kanagawa (JP)

( * ) Notice: Subject to any disclaimer, the term of this patent is extended or adjusted under 35 U.S.C. 154(b) by 4 days.

(21) Appl. No.: 15/077,291

(22) Filed: Mar. 22, 2016

(65) Prior Publication Data

US 2016/0281997 A1 Sep. 29, 2016

(30) Foreign Application Priority Data

Mar. 24, 2015 (JP) ..... 2015-060921

(51) Int. Cl.

| | |
|---|---|
| ***F24H 3/06*** | (2006.01) |
| ***F24F 1/00*** | (2011.01) |
| ***F24F 13/22*** | (2006.01) |
| ***F24F 13/20*** | (2006.01) |
| ***F24F 13/30*** | (2006.01) |
| ***F24F 13/32*** | (2006.01) |

(52) U.S. Cl.

CPC ..... *F24F 1/0014* (2013.01); *F24F 1/0011* (2013.01); *F24F 1/0022* (2013.01); *F24F 13/20* (2013.01); *F24F 13/22* (2013.01); *F24F 13/222* (2013.01); *F24F 13/30* (2013.01); *F24F 13/32* (2013.01); *F24F 2001/0037* (2013.01)

(58) Field of Classification Search

CPC ..... F24F 1/0014; F24F 1/0022; F24F 2001/0037; F24F 13/20; F24F 13/22; F24F 13/222; F24F 13/30; F24F 13/32

See application file for complete search history.

(56) References Cited

U.S. PATENT DOCUMENTS

| | | | | |
|---|---|---|---|---|
| 6,450,880 | B1 * | 9/2002 | Asahina | F24F 1/0011 454/233 |
| 2006/0276123 | A1 * | 12/2006 | Sanagi | F24F 1/0011 454/292 |
| 2010/0192611 | A1 * | 8/2010 | Yamaguchi | F24F 13/14 62/291 |

FOREIGN PATENT DOCUMENTS

| | | | | |
|---|---|---|---|---|
| EP | 0834704 | A2 * | 4/1998 | F24F 1/0007 |
| JP | 2005249328 | A * | 9/2005 | |
| JP | 2006-153452 | A | 6/2006 | |

OTHER PUBLICATIONS

JP2005249328 machine translation.*

* cited by examiner

*Primary Examiner* — Len Tran
*Assistant Examiner* — Gordon Jones
(74) *Attorney, Agent, or Firm* — Manabu Kanesaka

(57) ABSTRACT

A ceiling-embedded air conditioner includes: a ceiling-embedded casing main body that includes inside thereof a turbo fan and a heat exchanger disposed to surround the outer periphery of the turbo fan; a decorative panel that is mounted on a bottom surface of the casing main body and has an air blowoff opening; a drain pan that is provided on the bottom surface of the casing main body; an air blowoff path that is a through hole with rectangular cross section, the air blowoff path being provided in the drain pan and guiding conditioned air heat-exchanged by the heat exchanger to the air blowoff opening; and a reinforcement support column that is provided between long sides of the air blowoff path and includes a portion protruding more upward than an opening surface of the air blowoff path on an inflow side.

5 Claims, 6 Drawing Sheets

CEILING-EMBEDDED AIR CONDITIONER

CROSS-REFERENCE TO RELATED APPLICATION

This application claims priority from Japanese Patent Application No. 2015-060921 filed with the Japan Patent Office on Mar. 24, 2015, the entire content of which is hereby incorporated by reference.

BACKGROUND

1. Technical Field

The present disclosure relates to a ceiling-embedded air conditioner, more specifically, to a structure of an air blowoff path of a drain pan.

2. Description of the Related Art

In a ceiling-embedded air conditioner, a box-shaped casing body is embedded into a space formed between a ceiling slab and a ceiling panel. A square decorative panel is mounted on the bottom surface (facing the interior of a room) of the casing body. In general, an air suction opening is provided in the center of the decorative panel, and air blowoff openings are provided around the air suction opening. The casing body includes inside thereof a turbo fan, a heat exchanger surrounding the outer periphery of the turbo fan, and a drain pan disposed under the heat exchanger (for example, refer to JP-A-2006-153452).

Referring to FIG. 6, a drain pan 101 includes integrally a dew receiving portion 101*a* positioned under a heat exchanger 103 and an air blowoff path 105. The air blowoff path guides conditioned air heat-exchanged by the heat exchanger 103 to air blowoff openings formed in a decorative panel. The drain pan 101 is fitted as a frame body square in a plane view into the bottom surface side of a casing main body 102.

In many case, the entire drain pan 101 is made of a foamed polystyrene resin. The air blowoff path 105 is formed as an elongated rectangular through hole in a plane view that penetrates through the drain pan 101 in a thickness direction (an up-down direction in FIG. 6). Accordingly, the air blowoff path 105 is likely to become cracked in particular in the middle of the long side.

A reinforcement support column 106 is provided in the air blowoff path 105. The support column 106 is a transverse beam that runs horizontally between side walls 105*a* and 105*b* of the air blowoff path 105 on the long side. The support column 106 is conventionally provided in the air blowoff path 105.

SUMMARY

A ceiling-embedded air conditioner includes: a ceiling-embedded casing main body that includes inside thereof a turbo fan and a heat exchanger disposed to surround the outer periphery of the turbo fan; a decorative panel that is mounted on a bottom surface of the casing main body and has an air blowoff opening; a drain pan that is provided on the bottom surface of the casing main body; an air blowoff path that is a through hole with rectangular cross section, the air blowoff path being provided in the drain pan and guiding conditioned air heat-exchanged by the heat exchanger to the air blowoff opening; and a reinforcement support column that is provided between long sides of the air blowoff path and includes a portion protruding more upward than an opening surface of the air blowoff path on an inflow side.

DESCRIPTION OF THE EMBODIMENTS

Figure 1:
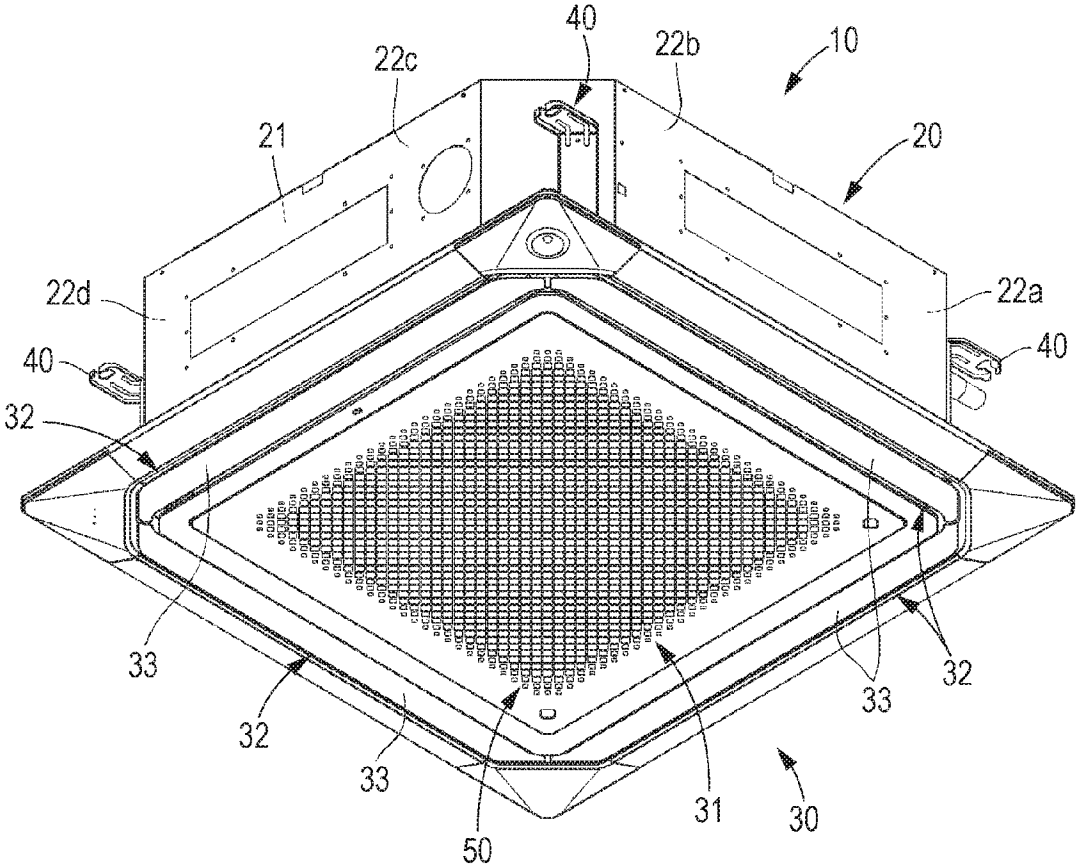
FIG. 1 is a perspective external view of a ceiling-embedded air conditioner according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 6:
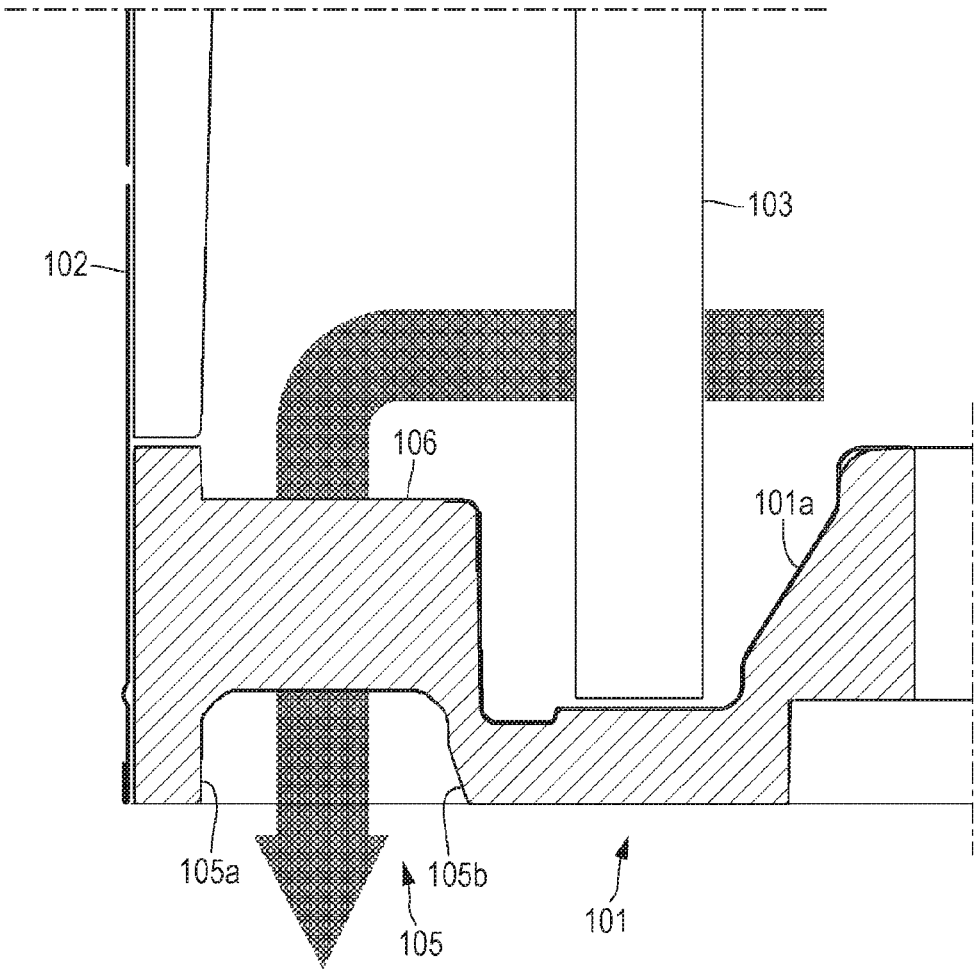
FIG. 6 is a partial cross-sectional view describing a configuration of a conventional air blowoff path.

In the configuration illustrated in FIG. 6, the support column 106 provided in the air blowoff path 105 constitutes resistance to air flowing in the air blowoff path 105. Accordingly, providing the support column 106 in the air blowoff path 105 reduces the volume of air blown from the air blowoff openings.

An object of the present disclosure is to provide a ceiling-embedded air conditioner including reinforcement support columns as described below. The reinforcement support columns maintain the mechanical strength of the air blowoff paths included in the drain pan and is less prone to hinder the air passing through the air blowoff paths.

A ceiling-embedded air conditioner according to an aspect of the present disclosure (the present air conditioner) includes: a ceiling-embedded casing main body that includes inside thereof a turbo fan and a heat exchanger disposed to surround the outer periphery of the turbo fan; a decorative panel that is mounted on a bottom surface of the casing main body and has an air blowoff opening; a drain pan that is provided on the bottom surface of the casing main body; an air blowoff path that is a through hole with rectangular cross section, the air blowoff path being provided in the drain pan guiding conditioned air heat-exchanged by the heat exchanger to the air blowoff opening; and a reinforcement support column that is provided between long sides of the air blowoff path and includes a portion protruding more upward than an opening surface of the air blowoff path on an inflow side.

In a more preferable aspect, the support column is formed in an arch shape and has inclined portions extending from the long sides as base end portions to the center in an obliquely upward direction and has a peak portion connecting ends of the inclined portions, and the peak portion is positioned more upward than the opening surface of the air blowoff path on the inflow side.

In a further more preferable aspect, the drain pan includes a foamed resin drain pan main body and a resin drain sheet formed integrally with the drain pan main body on the heat exchanger side, and the support column is formed as part of the drain sheet.

According to the present air conditioner, the reinforcement support columns in the air blowoff paths have the portions protruding more upward than the opening surfaces of the air blowoff paths on the inflow side. This makes the support columns less prone to hinder the air passing through the air blowoff paths. This suppresses reduction in the volume of air blown from the air blowoff openings.

Next, a specific embodiment of the present disclosure will be described with reference to the drawings. However, the technique of the present disclosure is not limited to this.

Figure 2:
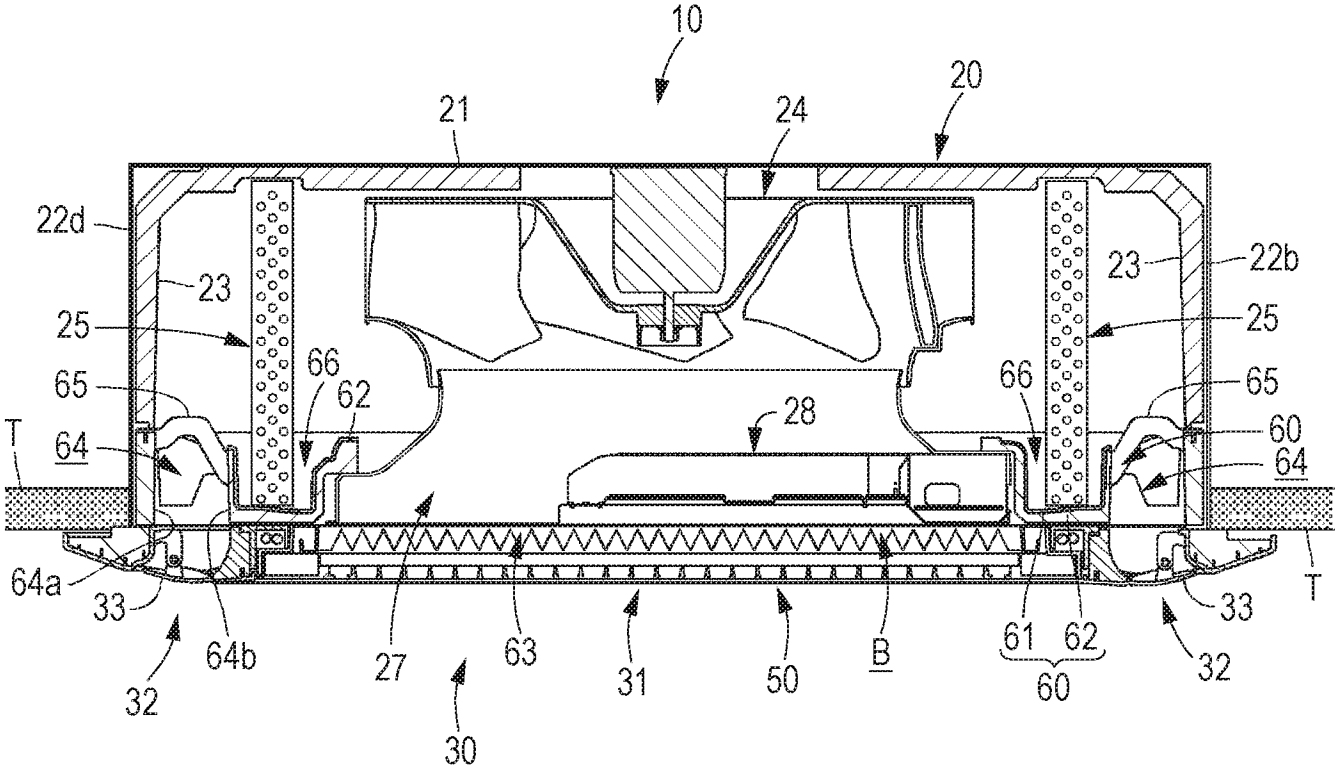
FIG. 2 is a cross-sectional view of main components of the ceiling-embedded air conditioner.

As illustrated in FIGS. 1 and 2, a ceiling-embedded air conditioner 10 includes a cuboidal casing main body 20 and a decorative panel 30. The casing main body 20 is stored in a space formed between a ceiling slab and a ceiling panel T. The decorative panel 30 is mounted on a bottom surface B of the casing main body 20. The casing main body 20 is hung by hanging bolts not illustrated on the ceiling slag side via hanging metal brackets 40 provided on the side surfaces of the casing main body 20 in such a manner as to be almost flush with the ceiling surface.

The decorative panel 30 is disposed along the ceiling panel (ceiling surface) T. The decorative panel 30 has an air suction opening 31 opened in a square in the center thereof. Air blowoff openings 32 are disposed at four places along the four sides of the air suction opening 31. A suction grill 50 is detachably attached to the air suction opening 31.

The air blowoff openings 32 are formed in a rectangular shape. The air blowoff openings 32 have rotatable wind direction plates 33. In a shutdown state, the wind direction plates 33 are closed to cover the air blowoff openings 32.

The casing main body 20 is a box-shaped container. The bottom surface B (bottom surface in FIG. 1) of the casing main body 20 is opened. The casing main body 20 has an octagonal top plate 21 with chamfered corners and four side plates 22 (22*a* to 22*d*) extending downward from the sides of the top plate 21. A heat insulator 23 made of foamed polystyrene is provided on the inner peripheral surface of the casing main body 20.

Figure 3:
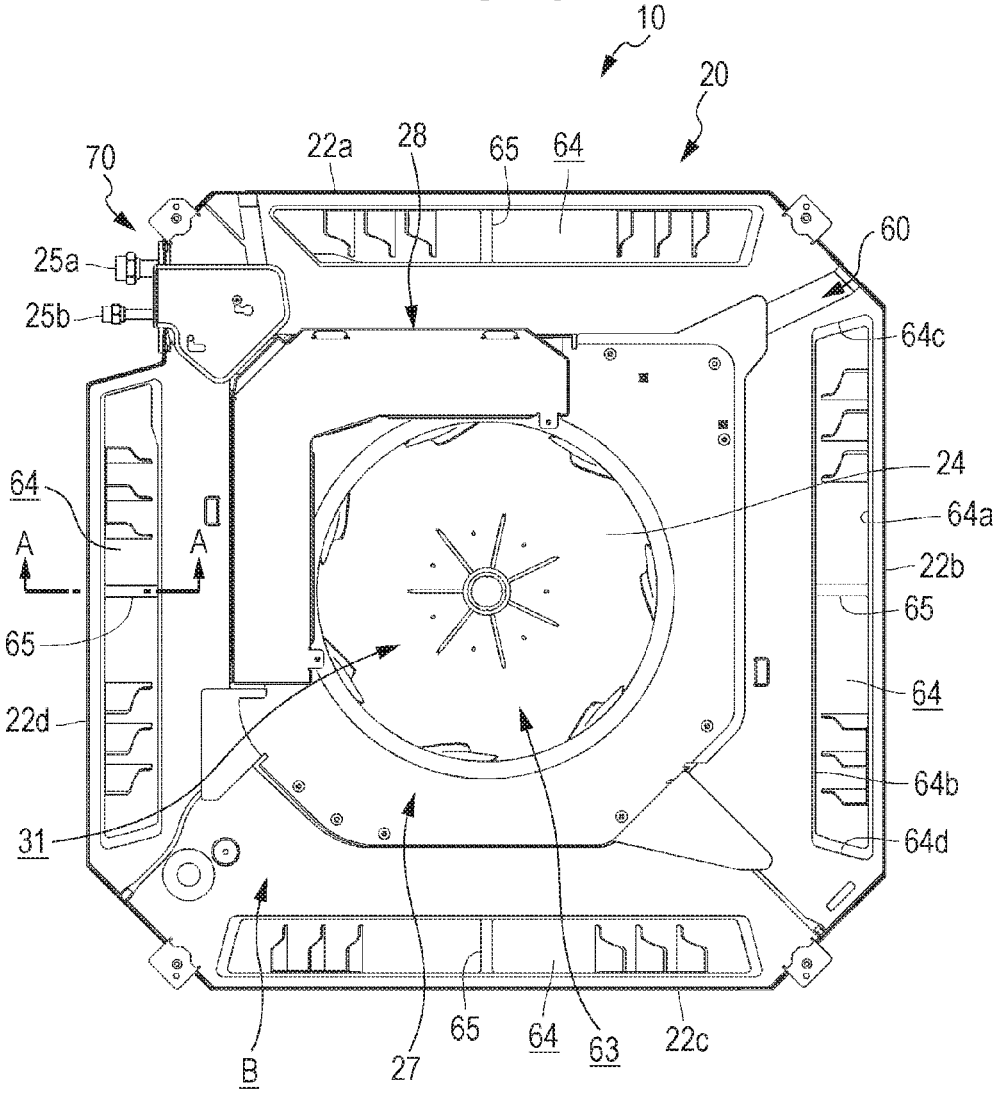
FIG. 3 is a front view of a casing main body with no decorative panel as seen from the bottom side.

Also referring to FIG. 3, the casing main body 20 is formed such that one of four corner portions (in this example, the corner portion where the side plates 22*a* and 22*d* are butted against each other) is recessed by one step from the outside to the inside. A pipe draw portion 70 is provided at the thus formed concave portion to draw refrigerant pipes 25*a* and 25*b* of a heat exchanger 25 to the outside.

A turbo fan 24 is disposed as an air blower almost in the center of inside of the casing main body 20. The heat exchanger 25 is disposed in a square frame shape, for example, on the outer periphery of the turbo fan 24 to surround the turbo fan 24.

Figure 5:
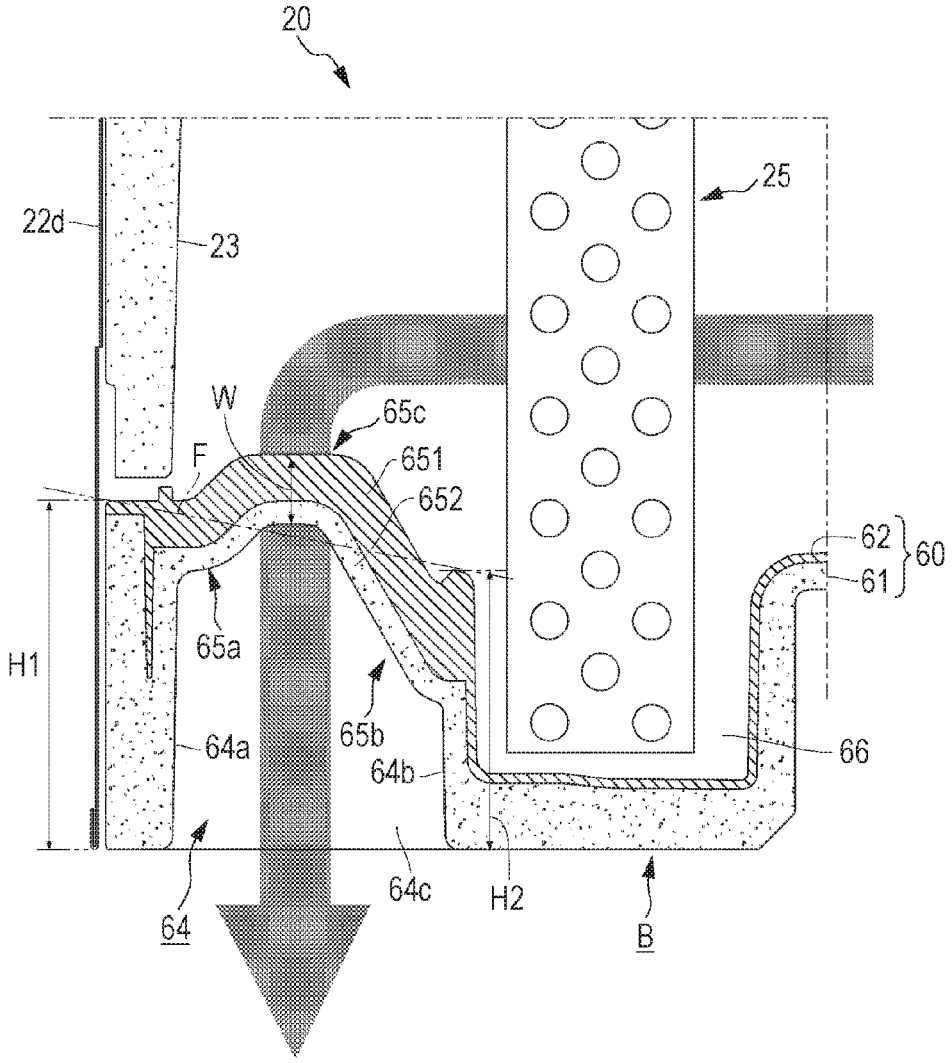
FIG. 5 is a cross-sectional view of FIG. 3 taken along line A-A.

A drain pan 60 is provided on the bottom surface of the casing main body 20 under the heat exchanger 25 to receive dew condensation water generated by the heat exchanger 25 during cooling operation. In the embodiment, the drain pan 60 is made of a foamed polystyrene resin. As illustrated in FIG. 5, the drain pan 60 includes a drain pan main body 61 having a dew receiving portion 66, air blowoff paths 64, and a resin drain sheet 62. The air blowoff paths 64 guide the conditioned air having passed through the heat exchanger 25 to the air blowoff openings 32 of the decorative panel 30. The resin drain sheet 62 is formed integrally with the drain pan main body 61 on the heat exchanger 25 side.

The drain pan 60 has a square frame shape in a plane view. The square frame of the drain pan 60 constitutes an air suction path 63 communicating with the air suction opening 31 of the decorative panel 30. A bell mouth 27 is provided in the air suction path 63. The bell mouth 27 guides the air sucked from the air suction opening 31 toward the suction side of the turbo fan 24.

Also referring to FIG. 3, an electric equipment box 28 is provided in the bell mouth 27 on the air suction opening 31 side. In the embodiment, the electric equipment box 28 is disposed in an L shape at the corner portion close to the pipe draw portion 70.

Figure 4:
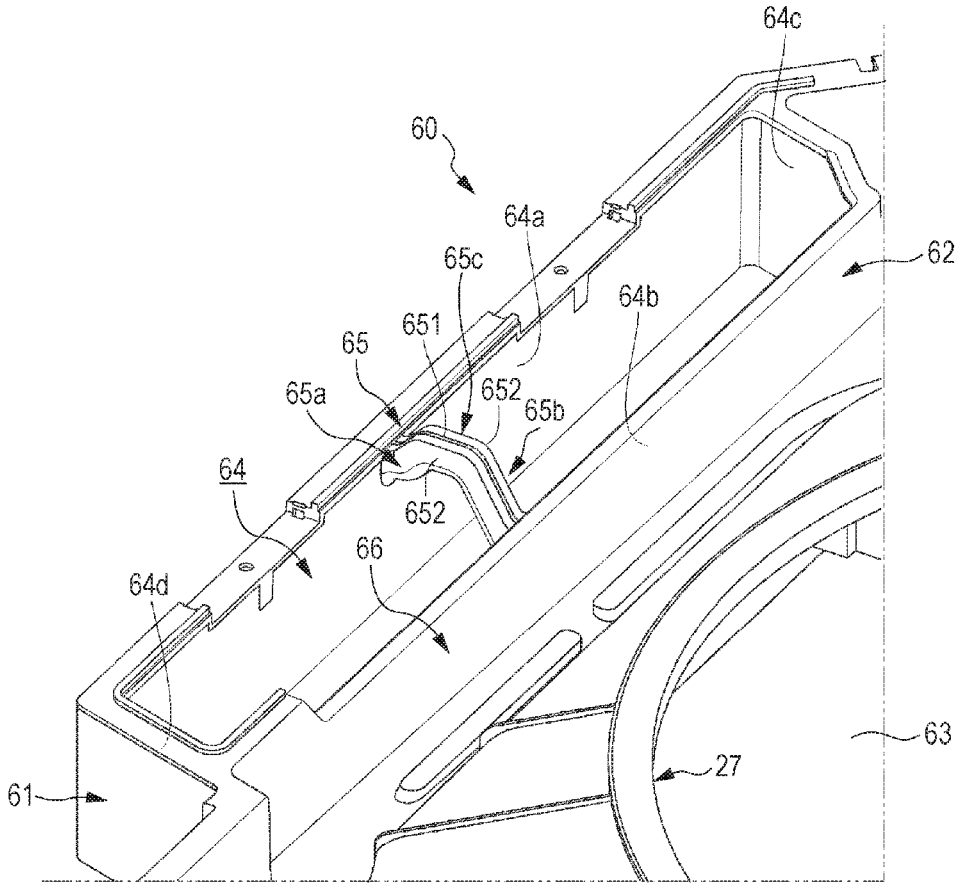
FIG. 4 is a partially enlarged perspective view of an inflow side of an air blowoff path of a drain pan.

In the embodiment, the air blowoff paths 64 are provided in the casing main body 20 at four places corresponding to the air blowoff openings 32 of the decorative panel 30. The four air blowoff paths 64 are almost the same in basic configuration, and one of them will be described with reference to FIGS. 4 and 5.

The air blowoff path 64 has a rectangular cross section surrounded by a pair of long side walls 64*a* and 64*b* and a pair of short side walls 64*c* and 64*d*. The pair of long side walls 64*a* and 64*b* is parallel to the side plates 22 of the casing main body 20, and is opposed to each other with a predetermined space therebetween. The pair of short side walls 64*c* and 64*d* are formed between the ends of the long side walls 64*a* and 64*b*. The air blowoff path 64 penetrates through the casing main body 20 in a thickness direction (an up-down direction in FIG. 5). In the embodiment, the air blowoff path 64 is formed in the drain pan main body 61.

As illustrated in FIG. 5, the opening portion of the air blowoff path 64 on the inflow side (upper side in FIG. 5) is formed such that a height H1 of the long side wall 64*a* on the side plate 22 side is higher than a height of the opposed long side wall 64*b* on the drain pan main body 61 side (H1>H2). A virtual opening surface F connecting a peak portion of the long side wall 64*a* and a peak portion of the long side wall 64*b* has a downward slope from the side plate 22 side to the drain pan main body 61 side. This makes it possible to take in the conditioned air having passed through the heat exchanger 25 in a more efficient manner.

The air blowoff path 64 has a support column (reinforcement support column) 65 between the pair of long side walls 64*a* and 64*b* on the inflow side. The support column 65 is used to supplement the mechanical strength of the air blowoff path 64 made of a foamed resin. The support column 65 run over between almost the middle portions of the opposed long side walls 64*a* and 64*b*. The support column 65 has a portion protruding more upward than the opening surface F of the air blowoff path 64 on the inflow side.

In the embodiment, the support column 65 is formed in an arch shape and has a first inclined portion 65*a*, a second inclined portion 65*b*, and a horizontal portion 65*c*. The first inclined portion 65*a* extends from the upper end side of the one long side wall 64*a* as a base end portion to the middle of the air blowoff path 64 in an obliquely upward direction in the air blowoff path 64. The second inclined portion 65*b* extends from the upper end side of the other long side wall 64*b* as a base end portion to the middle of the air blowoff path 64 in the obliquely upward direction in the air blowoff path 64. The horizontal portion 65*c* is a peak portion connecting the ends of the inclined portions 65*a* and 65*b*. To decrease ventilation resistance, part of the first inclined portion 65*a*, part of the second inclined portion 65*b*, and the horizontal portion 65*c* are positioned more upward than the opening surface F. Width W of the support column 65 in the height direction is almost uniform from the inclined portions 65*a* and 65*b* to the horizontal portion 65*c*.

In the conventional example of FIG. 6, the entire support column 106 is disposed in the air blowoff path 105. In contrast with this, in the embodiment, the volume of the support column 65 in the air blowoff path 64 can be made smaller than that in the conventional example. Therefore, the obstacles are decreased in the air blowoff path 64. As a result, the space in the air blowoff path 64 can be widened to reduce ventilation resistance.

In the embodiment, the drain sheet 62 is a pre-formed molded article. At the time of molding the drain pan 60, the drain sheet 62 is disposed as an insert in a metal mold for the drain pan main body 61. After that, the drain sheet 62 is integrated with the inner surface of the drain pan main body 61 simultaneously with the foam molding of the drain pan main body 61.

The drain sheet 62 includes a core material 651 as the center of the support column 65. At the time of insert molding of the drain pan 60, a foamed resin portion 652 is integrated with the outer peripheral surface of the core material 651 (the right and left side surfaces and the bottom surface in the embodiment). Accordingly, the support column 65 having the core material 651 and the foamed resin portion 652 is formed as part of the drain sheet 62. The support column 65 has a sandwich structure including the core material 651 and the foamed resin portion 652 and is high in mechanical strength. In addition, the sandwich structure prevents occurrence of dew condensation on the core material 651.

In the embodiment, the base end portions of the first inclined portion 65*a* and the second inclined portion 65*b* of the support column 65 are positioned more downward than the opening surface F of the air blowoff path 64 on the inflow side and are disposed in the air blowoff path 64. However, part of the support column 65 (preferably the middle portion) protrudes beyond the opening surface F to produce the effect of reducing ventilation resistance as described above. Alternatively, the support column 65 may be designed such that all its portions protrude more upward than the opening surface F. In this manner, when even part of the support column 65 equivalent to its thickness protrudes beyond the opening surface F, the space in the air blowoff path 64 can be widened. As a result, it is possible to obtain the effect of reducing ventilation resistance described above.

As described above, according to the embodiment, part of the support column 65 protrudes more upward than the opening surface F of the air blowoff path 64 on the inflow side. This makes the support column 65 less prone to hinder the air flowing in the air blowoff path. As a result, it is possible to suppress occurrence of disturbance flow and reduction of air volume.

The terms used herein indicating shapes or states such as "cuboidal," "octagonal," "parallel," "middle," "center," "entire," "horizontal," and "simultaneous" refer to not only strict shapes or states but also approximate shapes or states different from the strict shapes or states without deviating from the influences and effects of the strict shapes or states.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ceiling-embedded air conditioner comprising:

a ceiling-embedded casing main body that includes inside thereof a turbo fan and a heat exchanger disposed to surround the outer periphery of the turbo fan;

a decorative panel that is mounted on a bottom surface of the casing main body and has an air blowoff opening;

a drain pan that is provided on the bottom surface of the casing main body;

an air blowoff path that is a through hole with rectangular cross section, the air blowoff path being provided in the drain pan and guiding conditioned air heat exchanged by the heat exchanger to the air blowoff opening; and a reinforcement support column that is provided between center portions of long sides of the drain pan forming the air blowoff path and is located above the air blowoff path to reinforce the drain pan forming the are blowoff path, and includes a portion extending from the long sides as base end portions to a center of the air blowoff path in an obliquely upward direction and a peak portion connecting ends of the inclined portions to be formed in an arch shape, the peak portion being positioned higher than an opening surface of the air blowoff path on an inflow side, wherein both of the inclined portions are provided between the center portions of the long sides of the drain pan.

2. The ceiling-embedded air conditioner according to claim 1, wherein the drain pan includes a foamed resin drain pan main body and a resin drain sheet formed integrally with the drain pan main body on the heat exchanger side, and the support column is formed as part of the drain sheet.

3. The ceiling-embedded air conditioner according to claim 1, wherein the drain pan includes a pair of long side walls formed at the long sides and pair of short side walls connecting the pair of long side walls to form the air blowoff path thereinside, and the pair of long side walls includes a first long side wall arranged at an outer side, and a second long side wall arranged at an inner side to face the first long side wall and having a height shorter than that of the first long side wall to efficiently take the conditioned air in the air blowoff path.

4. The ceiling-embedded air conditioner according to claim 3, wherein the inclined portions include a first inclined portion extending from the first long side wall, and a second inclined portion extending from the second long side wall and having a length a middle portion between the pair of long side walls above the air blowoff path.

5. The ceiling-embedded air conditioner according to claim 1, wherein the casing main body further includes a top plate, four side plates extending downwardly from the top plate, and a heat insulator extending along inner surfaces of the top plate and each of the four side plates, and the drain pan is separately formed from the heat insulator along the four side plates under the heat insulator, and the inclined portions extend from upper end portions of the long sides of the drain pan.

* * * * *